US007703437B2

(12) United States Patent
Scheffler et al.

(10) Patent No.: US 7,703,437 B2
(45) Date of Patent: Apr. 27, 2010

(54) ELECTRONIC CONTROL DEVICE FOR CONTROLLING THE INTERNAL COMBUSTION ENGINE IN A MOTOR VEHICLE

(75) Inventors: Till Scheffler, Munich (DE); Georg Meder, Bloomfield Hills, MI (US); Wolfgang Heinle, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 12/247,123

(22) Filed: Oct. 7, 2008

(65) Prior Publication Data

US 2009/0037083 A1 Feb. 5, 2009

Related U.S. Application Data

(63) Continuation of application No. PCT/EP2007/004997, filed on Jun. 5, 2007.

(30) Foreign Application Priority Data

Jun. 7, 2006 (DE) ..... 10 2006 026 390

(51) Int. Cl.
*F02P 5/00* (2006.01)
*F02D 41/00* (2006.01)

(52) U.S. Cl. ..... 123/406.14; 123/691; 123/406.47

(58) Field of Classification Search ..... 123/406.14, 123/406.17, 434, 436, 673, 674, 680, 691, 123/692

See application file for complete search history.

(56) References Cited

U.S. PATENT DOCUMENTS 5,526,793 A * 6/1996 Johansson ..... 123/481
6,446,596 B1 * 9/2002 Moser et al. ..... 123/295
6,584,834 B1 7/2003 Lehner et al.
2003/0159677 A1 * 8/2003 Uhl ..... 123/436
2005/0005923 A1 1/2005 Herrin
2007/0199551 A1 * 8/2007 Porten et al. ..... 123/673

FOREIGN PATENT DOCUMENTS

DE 19735367 C1 9/1998

(Continued)

*Primary Examiner*—John T Kwon
(74) *Attorney, Agent, or Firm*—Barley Snyder LLC

(57) ABSTRACT

An electronic control device according to the invention is disclosed for controlling the internal combustion engine in a motor vehicle, for fault recognition with an irregular running determination unit and with an injection quantity correction unit, a defined group of cylinders being associated with a lambda probe, the injection quantity of a cylinder to be investigated of the defined group is adjusted in the direction of lean by a differential adjustment value associated with an irregular running differential value, and the injection value of at least one of the remaining cylinders, which are associated with the same lambda probe, is correspondingly adjusted in the direction of rich, so that in total a predetermined lambda value of this group of at least approximately 1 is reached. Homogeneous operation is thus ensured. The differential adjustment values may, for example, relate to the injection quantity itself, the injector stroke or the injection time. In this manner, a differential adjustment value individual to the cylinder is adjusted for each cylinder of the defined group. Correction values individual to the cylinder are then determined in that the differential adjustment values individual to the cylinder are related to one another.

8 Claims, 3 Drawing Sheets

FOREIGN PATENT DOCUMENTS

| | | | |
|---|---|---|---|
| DE | 19828279 | A1 | 12/1999 |
| DE | 10115902 | C1 | 7/2002 |
| DE | 10064665 | A1 | 8/2002 |
| DE | 10339251 | A1 | 3/2005 |
| DE | 102004030757 | A1 | 1/2006 |
| DE | 102005009101 | B3 | 3/2006 |
| EP | 0884465 | B1 | 10/2008 |
| WO | 96/35048 | | 11/1996 |
| WO | 99/67525 | | 12/1999 |

* cited by examiner

ELECTRONIC CONTROL DEVICE FOR CONTROLLING THE INTERNAL COMBUSTION ENGINE IN A MOTOR VEHICLE

CROSS REFERENCE TO RELATED APPLICATIONS

This application is a continuation of PCT International Application No. PCT/EP2007/004997, filed Jun. 5, 2007, which claims priority under 35 U.S.C. §119 to German Patent Application No. 10 2006 026 390.1, filed Jun. 7, 2006.

FIELD OF THE INVENTION

The invention relates to an electronic control device for controlling the internal combustion engine in a motor vehicle.

BACKGROUND

A device of this type is known, for example, from DE 198 28 279 A1. In this known device, a cylinder equalization based on the total torque is carried out. Desired values are determined from irregular running values individual to the cylinder. The equalization only takes place during lean operation. The object of the device known from this is primarily to optimize smooth engine running.

An object of the invention is to develop an improved mechanism of the type mentioned above with regard to a lambda equalization.

SUMMARY

The invention provides an electronic control device for controlling the internal combustion engine in a motor vehicle, with, for example, an irregular running determination unit and with, for example, an injection quantity correction unit. Using the electronic control device, a defined group of cylinders being associated with a lambda probe, the injection quantity of a cylinder to be investigated in the defined group is adjusted in the direction of lean by a differential adjustment value associated with an irregular running differential value, and the injection quantity of at least one of the remaining cylinders, which are associated with the same lambda probe, is correspondingly adjusted in the direction of rich, so that in total a predetermined lambda value of this group of at least approximately 1 is reached. Homogeneous operation is thus ensured. The differential adjustment values may, for example, relate to the injection quantity itself, the injector stroke or the injection time. In this manner, a differential adjustment value individual to the cylinder is adjusted for each cylinder of the defined group. Correction values individual to the cylinder are then determined in that the differential adjustment values individual to the cylinder are related to one another.

The lean adjustment according to the invention for fault recognition and correction value determination should not depart from homogeneous engine operation and a controlled catalyst concept, in particular for "lambda one". Described emission limits may therefore be reliably maintained.

The predetermined irregular running differential values for reaching a defined target lambda value may be empirically determined and stored under fault-free conditions.

The predetermined irregular running differential values may also be variably predetermined depending on the operating point.

In an advantageous embodiment of the invention, the average value is formed from all the differential adjustment values when inputting irregular running differential values associated in each case with the same target lambda value. The difference between this average value and the individual differential adjustment values is in each case stored as correction values individual to the cylinder. When inputting irregular running differential values associated with non-identical target lambda values for different cylinders, the differential adjustment values are corrected by means of a factor compensating the non-identical nature of the target lambda values. The average value is formed from these corrected differential adjustment values. The difference between this average value and the individual corrected differential adjustment values is then stored in each case as correction values individual to the cylinder.

When the operating point is changed during the lean adjustment of the differential adjustment values of a cylinder individual to the cylinder, the predetermined irregular running differential value can be adapted. In other words, during the lean adjustment of a cylinder, a new irregular running differential value can still be predetermined depending on the operating point.

The starting point of the injection quantity can also preferably be predetermined directly prior to the lean adjustment, depending on the operating point.

The aforementioned method by means of the electronic control device according to the invention, in particular the lean adjustment to determine the correction values, may be carried out in steady state operation, wherein for example the vehicle speed, the engine speed and/or the load move approximately within a predetermined tolerance range. Departure from steady state prior to completion of the correction value calculation, may trigger an abort condition for the method carried out by the control device.

In developing the invention the inventors have made certain findings which will now be discussed.

A constant injection time and quantity of injection of injectors for directly injecting engines based on piezoelectric technology, but also other injection systems, exhibit dependencies, in particular on temperature, pressure, age of the injector and aging of the activation electronics. Observation of injection quantities is generally based on the detection of lambda signals, which can be associated with an individual cylinder.

In lean operation (lambda>1) there is a clear relationship between the lambda values individual to the cylinder and the engine torque, because of the so-called lambda hook. Irregular running is assessed in conjunction with the required degree of leaning out. According to the invention, the injection quantity, for example the injection time of the injector, is always changed actively toward more lean (lambda>1) in relation to a cylinder. As the lean adjustment or the degree of leaning out is therefore known, it can be estimated with the aid of the reaction with regard to the irregular running what injection quantity is delivered without lean adjustment. As a result, it becomes possible to calibrate the injector for a homogeneous operation in which no clear relationship exists between lambda values individual to the cylinder and the engine torque or the irregular running. Basically, instead of the irregular running, the lambda signal or a combination of irregular running and lambda signal could also be evaluated if the signal amplitude of the lambda probe is adequately large.

The stable use of piezoelectric injectors in engines with high cylinder capacity, in particular, becomes possible through the invention. Furthermore, the firing interval and position of the lambda probe are immaterial here.

BRIEF DESCRIPTION OF THE DRAWINGS

An embodiment of the invention will be described in more detail with the aid of the drawings, in which.

DETAILED DESCRIPTION OF THE EMBODIMENTS

Figure 1:
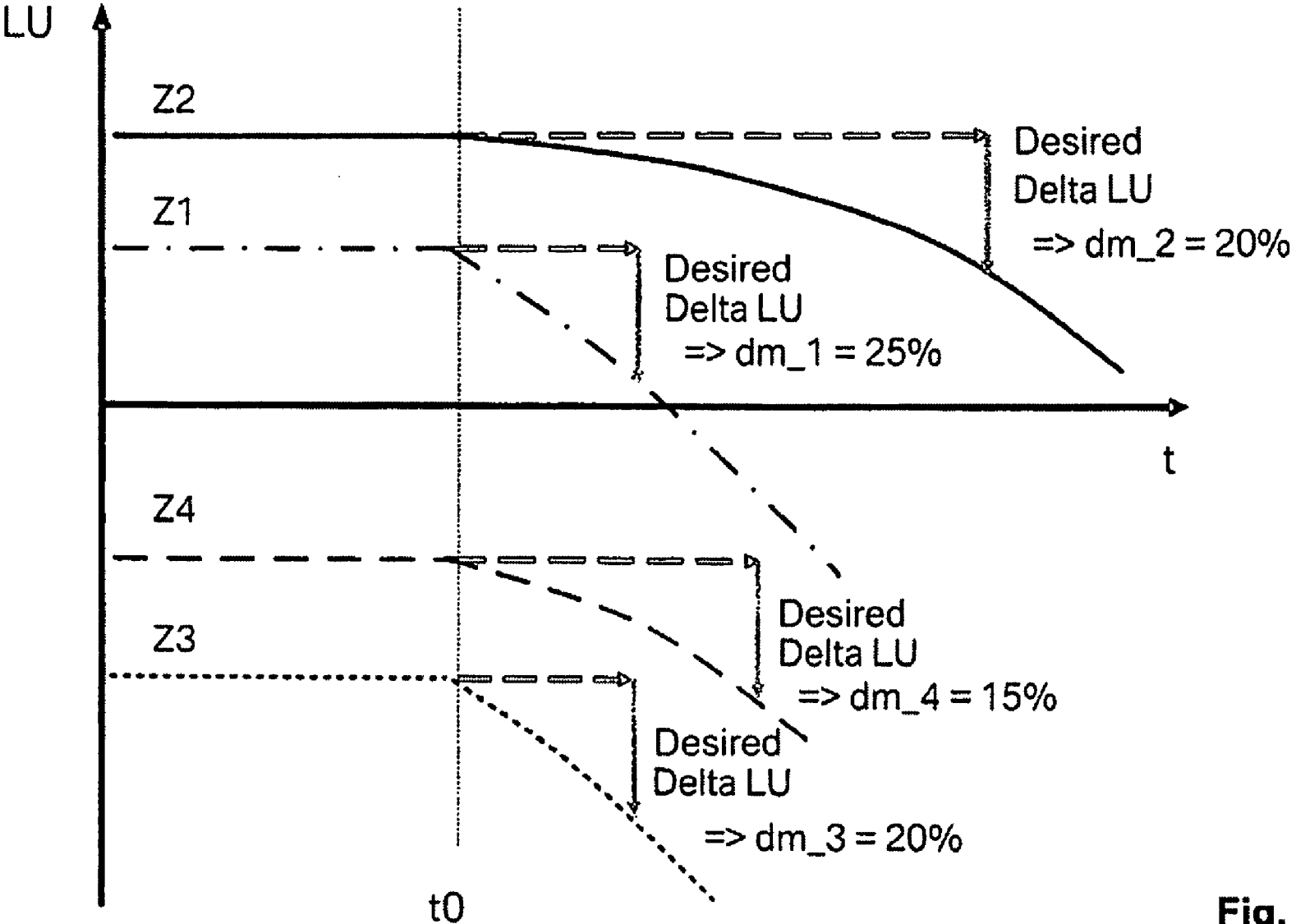
FIG. 1 is a characteristic time graph showing a lean adjustment individual to the cylinder, according to the invention, using the example of an exhaust gas system with four cylinders

In FIG. 1, the characteristic of an irregular running value LU is shown over time t for a group of four cylinders Z1, Z2, Z3 and Z4 of a common lambda probe, not shown herein.

Figure 2:
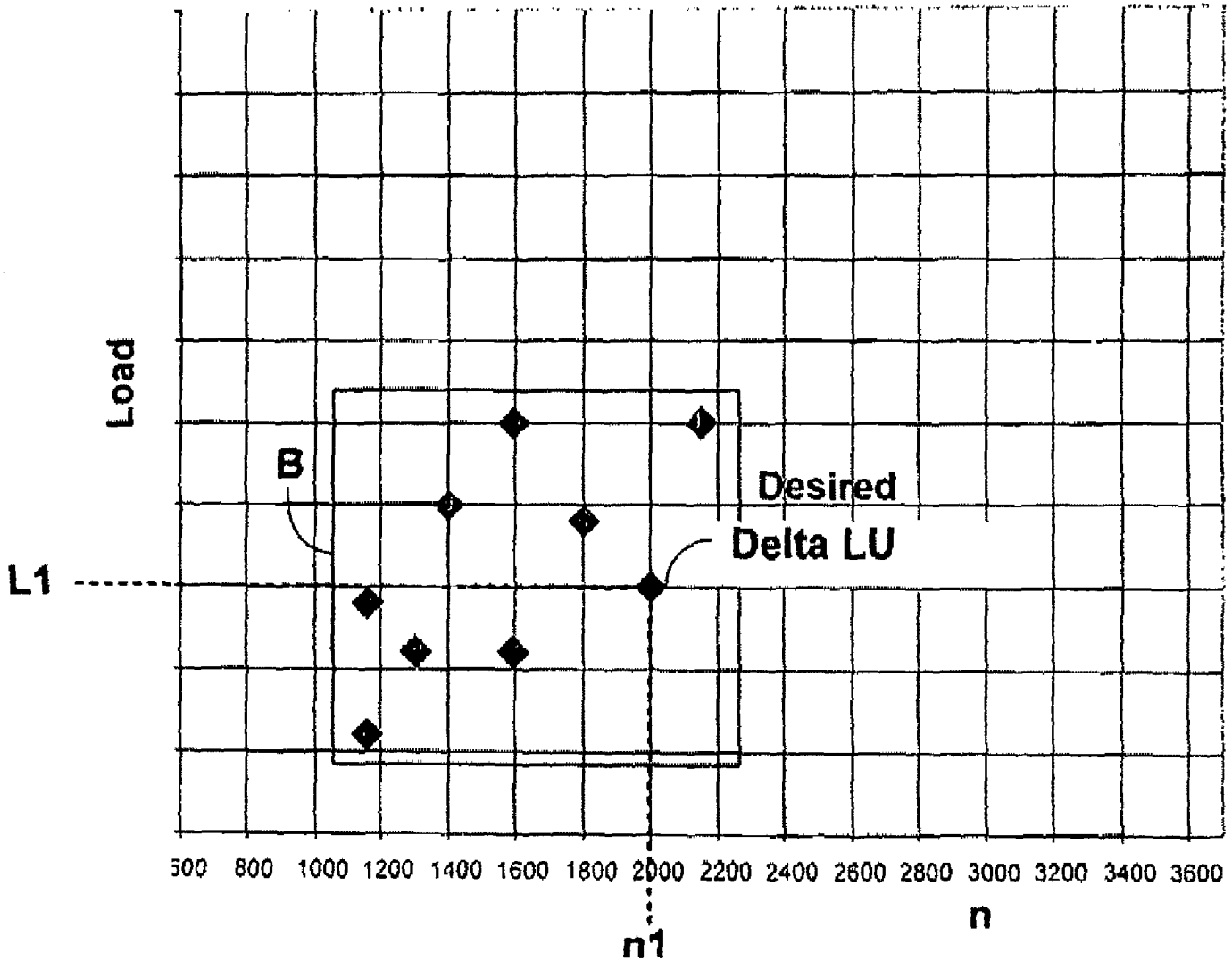
FIG. 2 shows an example of inputting, depending on the operating point, an irregular running differential value predetermined for the lean adjustment

In FIG. 2, in steady state operation at a current operating point, a predetermined irregular running differential value delta LU is to be selected at the instant t0 as the desired value, for example when the engine speed n=n1 and the load point L1, from a characteristic map as a function of the engine speed n and the load. The characteristic map may in this case have a core region B with empirically determined irregular running differential values.

The irregular running differential values delta LU predetermined by the core region B are empirically determined to reach a defined target lambda value under fault-free conditions and are stored in the control unit. For example, at an irregular running differential value delta LU desired, a target lambda value of 1.2 was determined at the engine speed n=n1 and the load point L1 under fault-free conditions. This corresponds to a degree of leaning out of 20%. Thus, for example, if there should be no fault-free condition with regard to a certain cylinder because of aging of an injector, a different differential adjustment value will be produced, with regard to the injection quantity during the lean adjustment thereof until a predetermined irregular running differential value delta LU desired is reached from in a fault-free condition. With a fault-free condition, a differential adjustment value of 20% would be produced in the operating point shown.

The cylinders are thus adjusted to lean from the instant t0, in each case, for example according to their ignition sequence until this predetermined irregular running differential value delta LU desired is reached. The adjustment may, for example, be made abruptly and/or in the form of a ramp. As the two examples in FIG. 3 also show, from t0, a part adjustment is preferably firstly abruptly started and then carried on in a ramp-like manner. In this case, the injection quantity of a first cylinder Z1 to be investigated is firstly adjusted in the direction of lean by a differential adjustment value dm_1, here for example by 25%, in order to reach the predetermined irregular running differential value delta LU desired. The injection quantity of the remaining cylinders Z2, Z3, Z4 is preferably correspondingly adjusted in the direction of rich in approximately identical parts, so in total a lambda value of at least approximately 1 is reached. The differential adjustment values individual to the cylinder, here for example dm_2=20%, dm_3=20%, dm_4=15%, are determined or adjusted one after the other in the same manner for each cylinder. Thereafter, the average value is formed from all the differential adjustment values dm_1, dm_2, dm_3, dm_4, 20% here. The difference between this average value and the individual differential adjustment values dm_1, dm_2, dm_3, dm_4 are in each case stored as correction values individual to the cylinder and then adjusted accordingly to correct the injection quantities. Here: the correction value for cylinder Z1=5%, for cylinder Z2=0%, for cylinder Z3=0% and for cylinder Z4=−5%.

If the faults are considered in relation to lambda based on the assumption of an ideal state in the desired homogeneous operation, according to the example mentioned, in cylinder Z1 instead of the lambda value 1 there was actually a lambda value of 0.95 and in cylinder Z4 instead of the lambda value 1 there was a lambda value of 1.05. The cylinders Z2 and Z3 were fault-free.

In the embodiment mentioned, it is assumed that, during the determination of all the correction values and therefore also the predetermined irregular running differential value delta LU desired, the operating point (in this case: engine speed n=n1 and load point L1) did not change to reach the defined target lambda value (of 1.2 in this case).

However, the operating point may still change both during the lean adjustment of a cylinder and between the lean adjustment of different cylinders. As a result, different, also irregular running differential values (delta LU desired), also associated with non-identical target lambda values, may be predetermined. The target lambda values are selected in such a way that, on the one hand, an adequate degree of leaning out for fault measurement or correction value determination is achieved, but, on the other hand, depending on the operating point, a leaning out capacity is present, as a degree of leaning out which leads, for example, to a cylinder misfiring is not desired.

During an operating point shift between the lean adjustment of different cylinders, the differential adjustment values dm_1, dm_2, dm_3, dm_4 individual to the cylinders are also adjusted in each case in such a way that, as a result, the respectively predetermined operating point-dependent irregular running differential value delta LU desired is reached. However, if irregular running differential values delta LU desired associated with non-identical target lambda values are predetermined for different cylinders, the differential adjustment values are corrected by means of a factor compensating the non-identical nature of the target lambda values. The average value is then formed from these corrected differential adjustment values. The difference between the average value and the individual corrected differential adjustment values is in each case stored in turn as correction values individual to the cylinder.

When there is a change in the operating point during the lean adjustment of the differential adjustment values dm_1, dm_2, dm_3, dm_4 of a cylinder individual to the cylinder, the predetermined operating point-dependent irregular running differential value delta LU desired is optionally adapted.

Figure 3:
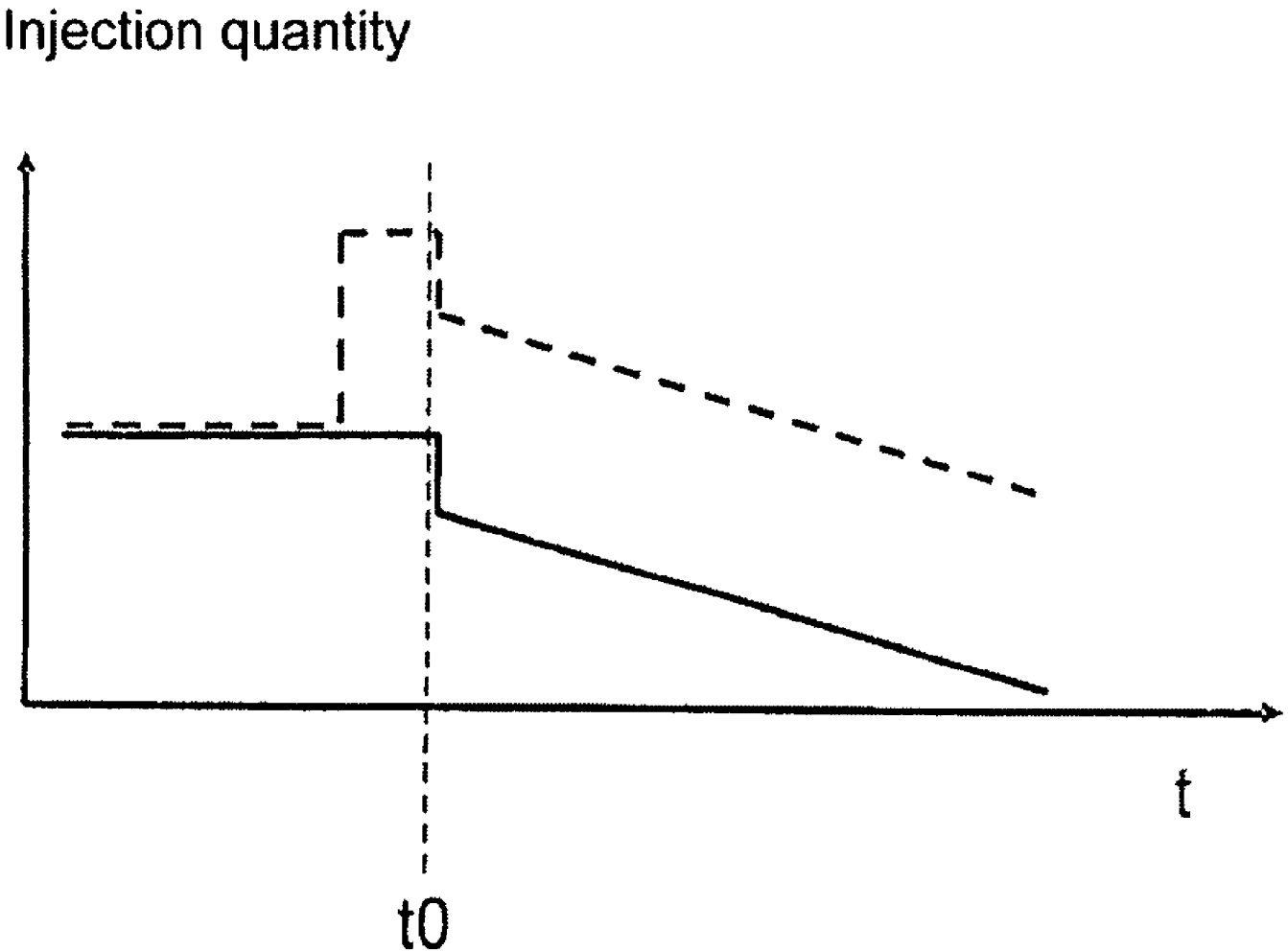
FIG. 3 shows two examples of a possible characteristic of the injection quantity shortly before and during the lean adjustment of a cylinder over the time

In an advantageous manner, the starting value of the injection quantity can also be predetermined directly before the lean adjustment, in particular depending on the operating point, i.e. can also be briefly changed with regard to the instantaneous actual value of the injection quantity. The example according to the dashed line in FIG. 3 shows a brief raising of the starting value of the injection quantity prior to the instant t0. In the example according to the solid line in FIG. 3, the actual value of the injection quantity is selected to be invariably equal to the starting value of the injection quantity.

The procedure described here is implemented by an injection quantity correction unit, preferably in the form of a program module in the electronic control device. A control device of this type or the program modules thereof receive the necessary input signals or input data via connections to other control devices or sensors.

What is claimed is:

1. An electronic control device for controlling the internal combustion engine in a motor vehicle having an irregular running determination unit wherein a defined group of cylinders is associated with a lambda probe, the device comprising:

an injection quantity correction unit, wherein an injection quantity of a cylinder to be investigated in the defined group is adjustable in the direction of lean by a differential adjustment value, associated with an irregular running differential value and the injection quantity of at least one of the remaining cylinders, which are associated with the same lambda probe, is adjustable accordingly in the direction of rich, so that in total, a predetermined lambda value of the group, of at least approximately 1, is achieved, wherein a differential adjustment value individual to the cylinder is adjustable in this manner for each cylinder of the defined group, wherein correction values individual to the cylinder are determined, and wherein the differential adjustment values individual to the cylinder are related to one another.

2. The electronic control device according to claim 1, wherein the predetermined irregular running differential values for reaching a defined target lambda value are empirically determined under fault-free conditions and stored.

3. The electronic control device according to claim 1 wherein the predetermined irregular running differential value is variably predetermined depending on the operating point.

4. The electronic control device according to claim 1, wherein differential adjustment values individual to the cylinder are adjusted in each case so that a respective predetermined irregular running differential value is reached wherein when inputting irregular running differential values associated in each case with the identical target lambda value, an average value is formed from all the differential adjustment values and wherein the difference between the average value and the individual differential adjustment values is in each case stored as correction values individual to the cylinder.

5. The electronic control device according to claim 1, wherein differential adjustment values individual to the cylinder are in each case adjusted in such a way that, as a result, a predeterminable operating point-dependent irregular running differential value is reached in each case, wherein when inputting irregular running differential values associated with non-identical target lambda values for different cylinders, the differential adjustment values are corrected by means of a factor compensating the non-identical nature of the target lambda values, and wherein an average value is formed from these corrected differential adjustment values and wherein the difference between the average value and the individual corrected differential adjustment values is stored in each case as correction values individual to the cylinder.

6. The electronic control device according to claim 5, wherein in the event of a change in the operating point during the lean adjustment of the differential adjustment values of a cylinder, the predetermined operating point-dependent irregular running differential value is adapted.

7. The electronic control device according to claim 1, wherein the lean adjustment is carried out to determine the correction values in steady state operation.

8. The electronic control device according to claim 1 wherein the staffing value of the injection quantity can also be predetermined directly prior to the lean adjustment, depending on the operating point.

* * * * *